US011791569B2

(12) United States Patent
Liu et al.

(10) Patent No.: US 11,791,569 B2
(45) Date of Patent: Oct. 17, 2023

(54) ANTENNA AND TERMINAL

(71) Applicant: Huawei Technologies Co., Ltd., Shenzhen (CN)

(72) Inventors: Jie Liu, Wuhan (CN); Jinjin Shao, Wuhan (CN); Liang Ma, Wuhan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 430 days.

(21) Appl. No.: 17/209,676

(22) Filed: Mar. 23, 2021

(65) Prior Publication Data

US 2021/0210872 A1 Jul. 8, 2021

Related U.S. Application Data

(63) Continuation of application No. PCT/CN2018/109201, filed on Sep. 30, 2018.

(51) Int. Cl.
*H01Q 1/24* (2006.01)
*H01Q 21/28* (2006.01)
(Continued)

(52) U.S. Cl.
CPC ..... *H01Q 21/28* (2013.01); *H01Q 1/38* (2013.01); *H01Q 9/065* (2013.01);
(Continued)

(58) Field of Classification Search
CPC ..... H01Q 21/28; H01Q 1/38; H01Q 9/065; H01Q 21/0006; H01Q 1/3275; H01Q 1/36; H01Q 1/48
See application file for complete search history.

(56) References Cited

U.S. PATENT DOCUMENTS 6,320,545 B1 11/2001 Nagumo et al.
7,064,729 B2 6/2006 Olson
(Continued)

FOREIGN PATENT DOCUMENTS

CA 2310682 A1 12/2000
CN 2671143 Y 1/2005
(Continued)

OTHER PUBLICATIONS

Valizade, A. et al., "A Novel Design of Reconfigurable Slot Antenna with Switchable Band Notch and Multiresonance Functions for UWB Applications," IEEE Antennas and Wireless Propagation Letters, vol. 11, 2012, 4 pages.
(Continued)

*Primary Examiner* — Joseph J Lauture
(74) *Attorney, Agent, or Firm* — SLATER MATSIL, LLP

(57) ABSTRACT

An antenna includes a first antenna having a first feeding portion and at least one stub, and a second antenna having a second feeding portion and at least one stub. The first feeding portion is disposed on a first side of a first diagonal line of the rectangular region. The at least one stub of the first antenna extends from the first feeding portion in a first direction. A first angle is between the first direction and a long-edge direction of the rectangular region. The second feeding portion is disposed on a second side of the first diagonal line of the rectangular region. The at least one stub of the second antenna extends from the second feeding portion in a second direction. A second angle is between the second direction and the long-edge direction of the rectangular region and is different from the first angle.

20 Claims, 9 Drawing Sheets

(51) Int. Cl.

| | |
|---|---|
| ***H01Q 1/38*** | (2006.01) |
| ***H01Q 9/06*** | (2006.01) |
| ***H01Q 21/00*** | (2006.01) |
| *H01Q 1/32* | (2006.01) |
| *H01Q 1/36* | (2006.01) |
| *H01Q 1/48* | (2006.01) |

(52) U.S. Cl.
CPC ..... *H01Q 21/0006* (2013.01); *H01Q 1/3275* (2013.01); *H01Q 1/36* (2013.01); *H01Q 1/48* (2013.01)

(56) References Cited

U.S. PATENT DOCUMENTS

| | | | | |
|---|---|---|---|---|
| 7,071,875 | B2 | 7/2006 | Sugimoto et al. | |
| 7,755,559 | B2 | 7/2010 | Pakosz et al. | |
| 9,099,773 | B2 | 8/2015 | Puente Baliarda et al. | |
| 9,437,935 | B2 | 9/2016 | DeLuis et al. | |
| 9,729,213 | B2 | 8/2017 | Hartenstein | |
| 2006/0284780 | A1 | 12/2006 | Chen et al. | |
| 2007/0152885 | A1 | 7/2007 | Sorvala | |
| 2008/0246670 | A1 | 10/2008 | Vlad et al. | |
| 2010/0149058 | A1 | 6/2010 | Bosshard et al. | |
| 2011/0263217 | A1 | 10/2011 | Chiu et al. | |
| 2014/0242903 | A1 | 8/2014 | DeLuis et al. | |
| 2017/0170552 | A1* | 6/2017 | Baek ..... | H01Q 1/36 |
| 2017/0373393 | A1 | 12/2017 | Tatomirescu et al. | |

FOREIGN PATENT DOCUMENTS

| | | | |
|---|---|---|---|
| CN | 1723588 | A | 1/2006 |
| CN | 201576755 | U | 9/2010 |
| CN | 102117962 | A | 7/2011 |
| CN | 102832455 | A | 12/2012 |
| CN | 103337696 | A | 10/2013 |
| CN | 103633438 | A | 3/2014 |
| CN | 105009364 | A | 10/2015 |
| CN | 204720560 | U | 10/2015 |
| CN | 105027352 | A | 11/2015 |
| CN | 105990693 | A | 10/2016 |
| CN | 106602267 | A | 4/2017 |
| CN | 206163700 | U | 5/2017 |
| CN | 106876983 | A | 6/2017 |
| CN | 107834183 | A | 3/2018 |
| CN | 207517873 | U | 6/2018 |
| CN | 108521014 | A | 9/2018 |
| EP | 2642587 | A1 | 9/2013 |
| JP | 2012064993 | A | 3/2012 |
| WO | 2015160200 | A1 | 10/2015 |

OTHER PUBLICATIONS

Sane, L. et al., "Dual-Band Pattern Reconfigurable 5G Antenna using Dual-Band BLC," 2018 IEEE Conference on Antenna Measurements and Applications (CAMA), XP033444241, Date of Conference: Sep. 3-6, 2018, 4 pages.

Shao, J.J. et al., "A Resistor-Loaded UWB TEM Horn Antenna," Journal of Micorwaves, vol. 30, No. 2, Apr. 2014, 5 pages (English Abstract).

Zhang, M. et al., "A Dual-Band MIMO Antenna with High Isolation for Internet Things," Telecommunication Engineering, vol. 58, No. 2, Feb. 2018, 4 pages (English Abstract).

Zhou, J. et al., "A Multiband Monopole Antenna with Arrow-Shaped Aperture-Coupled Resonators," 2017 Progress in Electromagnetics Research Symposium, Fall (PIERS—FALL) Nov. 19-22, 2017, 6 pages.

* cited by examiner

ANTENNA AND TERMINAL

CROSS-REFERENCE TO RELATED APPLICATIONS

This application is a continuation of International Application No. PCT/CN2018/109201, filed on Sep. 30, 2018, the disclosure of which is hereby incorporated by reference in its entirety.

TECHNICAL FIELD

This application relates to the field of communications technologies, and in particular, to an antenna and a terminal.

BACKGROUND

With continuous development of communications technologies, more and more devices and apparatuses are used in constructing communications networks. Antennas responsible for transmitting and receiving wireless signal electromagnetic waves for interconnection between communications apparatuses have attracted more and more attention. As sizes of appearances of antennas are designed to be thinner and smaller, people have increasing demand for antennas capable of processing a multi-band electromagnetic wave.

An antenna of an optical network termination (ONT) in the conventional technology needs to be capable of receiving or sending both an electromagnetic wave of a 2.4 gigahertz (2.4G) band and an electromagnetic wave of a 5 gigahertz (5G) band. Therefore, the antenna of the ONT is usually a dual-band antenna. The dual-band antenna includes a 2.4G antenna and a 5G antenna that are connected. The 2.4G antenna and the 5G antenna use a solution of a single feed point and share a cable and a balun. To be specific, the dual-band antenna may receive or send the electromagnetic wave of the 2.4G band by using the 2.4G antenna thereof, or may receive or send the electromagnetic wave of the 5G band by using the 5G antenna thereof, and the 2.4G antenna and the 5G antenna receive or send electromagnetic waves on a same path.

When the dual-band antenna in the conventional technology is used, to achieve a smaller size of the antenna, the 2.4G antenna and the 5G antenna need to be disposed together in a "back-to-back" manner. However, this overemphasis on reduction of the size of the dual-band antenna results in that the 2.4G antenna and the 5G antenna of the dual-band antenna are relatively close to each other. As a result, when one antenna works, the antenna is interfered by the other antenna. Therefore, how to reduce mutual interference between the antennas of the two bands while the dual-band antenna has a relatively small size is a technical problem to be urgently resolved at present.

SUMMARY

This application provides an antenna and a terminal, to reduce mutual interference between antennas of two bands while a dual-band antenna has a relatively small size.

According to a first aspect of this application, an antenna is provided, including a printed circuit board (PCB), a first antenna, and a second antenna.

The first antenna is partially or entirely printed in a rectangular region of a first surface of the PCB, and is configured to respond to an electromagnetic wave of a first band. The second antenna is entirely printed in the rectangular region, and is configured to respond to an electromagnetic wave of a second band.

The first antenna includes a first feeding portion and at least one stub.

The first feeding portion is disposed on a first side of a first diagonal line of the rectangular region, and is configured to perform mutual conversion between the electromagnetic wave of the first band and a wired signal. The at least one stub of the first antenna extends from the first feeding portion in a first direction. There is a first angle between the first direction and a long-edge direction of the rectangular region.

The second antenna includes a second feeding portion and at least one stub.

The second feeding portion is disposed on a second side of the first diagonal line of the rectangular region, and is configured to perform mutual conversion between the electromagnetic wave of the second band and a wired signal. The at least one stub of the second antenna extends from the second feeding portion in a second direction. There is a second angle between the second direction and the long-edge direction of the rectangular region. The first angle is different from the second angle.

Therefore, in the antenna provided in this embodiment, a structure in which the first antenna and the second antenna extend in different directions and are disposed on the two sides of the diagonal line of the same rectangular region is used, and the structure can fully utilize space of the rectangular region, so that the two antennas extending at different angles can be as close as possible. In addition, because there is a specific angle between the first antenna and the second antenna, a polarization difference can be further formed, thereby reducing mutual interference between the first antenna and the second antenna. In conclusion, the antenna provided in this application can reduce mutual interference between the antennas of the two bands while the antenna has a relatively small size.

In an embodiment of the first aspect of this application, the first antenna specifically includes a first stub and a second stub, and equivalent lengths of the first stub and the second stub are both ¼ of a wavelength of the electromagnetic wave of the first band.

A first portion of the first stub extends from the first feeding portion in the first direction. A second portion of the first stub extends from an end of the first portion of the first stub and is disposed along a long edge on the first side.

A first portion of the second stub extends from the first feeding portion in a reverse direction of the first direction. A second portion of the second stub extends from an end of the first portion of the second stub and is disposed along a wide edge on the first side.

The second antenna specifically includes a third stub and a fourth stub, and equivalent lengths of the third stub and the fourth stub are both ¼ of a wavelength of the electromagnetic wave of the second band.

A first portion of the third stub extends from the second feeding portion in the second direction. A second portion of the third stub extends from an end of the first portion of the third stub and is disposed along a long edge or a wide edge on the second side.

A first portion of the fourth stub extends from the second feeding portion in a reverse direction of the second direction and is disposed along the long edge on the second side.

In an embodiment of the first aspect of this application, an equivalent length of a stub of the antenna includes that a wavelength of an electromagnetic wave to which the stub that has not been bent can respond at the equivalent length is the same as a wavelength of an electromagnetic wave to which the stub that has been bent can respond at an actual length. The equivalent length is ¼ of the wavelength of the electromagnetic wave.

Therefore, when the first antenna and the second antenna are dipole antennas, a size of the antenna provided in this application can be reduced by further bending two stubs of the dipole antenna. Because the stub of the antenna is bent, a length and a width of the stub need to be correspondingly changed, so that a wavelength of an electromagnetic wave to which the stub that has been bent can respond at the actual length is the same as a wavelength of an electromagnetic wave to which a stub whose equivalent length is ¼ of the wavelength of the electromagnetic wave responds, thereby further reducing the size of the antenna.

In an embodiment of the first aspect of this application, the second direction is parallel to the long-edge direction of the rectangular region, or the second direction is perpendicular to the long-edge direction of the rectangular region.

In an embodiment of the first aspect of this application, the second portion of the first stub is bent along the long edge on the first side, and the second portion of the first stub includes at least one bent portion.

The second portion of the second stub is bent along the wide edge on the first side, and the second portion of the second stub includes at least one bent portion.

The second portion of the third stub is bent along the long edge or the wide edge on the second side, and the second portion of the third stub includes at least one bent portion.

A second portion of the fourth stub is bent along the long edge on the second side, and the second portion of the fourth stub includes at least one bent portion.

Therefore, based on the foregoing embodiments, in the antenna provided in this embodiment, the stubs of the first antenna and the second antenna can be further bent for a plurality of times, and each stub includes at least one bent portion, thereby further reducing the size of the antenna.

In an embodiment of the first aspect of this application, the first antenna is partially printed in the rectangular region.

The first portion of the first antenna is printed in the rectangular region, the second portion of the first antenna is a steel sheet connected to the first portion of the first antenna, and a plane on which the second portion of the first antenna is located is parallel to the first surface.

Therefore, in the antenna provided in this embodiment, because a part of the antenna is printed on the PCB and a part of the antenna extends out of the PCB, a PCB area occupied by the antenna can be further reduced. An area that is occupied by the antenna and that is of the rectangular region on the PCB is further reduced in comparison. In addition, the antenna provided in this embodiment can fully utilize space in a terminal device. When there is a gap between a PCB of the terminal device and a housing of the terminal device, the second portion of the first antenna of the antenna in this embodiment is disposed in the gap between the PCB and the housing in a form of a steel sheet, thereby further improving space utilization in the terminal device.

In an embodiment of the first aspect of this application, the first antenna is partially printed in the rectangular region.

The first portion of the first antenna is printed in the rectangular region, and the first portion includes an endpoint that is of the at least one stub of the first antenna and that extends from the first feeding portion in the first direction.

The second portion of the first antenna is a steel sheet connected to the first portion of the first antenna, and a plane on which the steel sheet is located is perpendicular to the first surface.

Therefore, in the antenna provided in this embodiment, because there is a specific angle between the first antenna and the second antenna, a polarization difference can be further formed, thereby reducing mutual interference between the first antenna and the second antenna and ensuring relatively high isolation between the first antenna and the second antenna. In this way, mutual interference between the antennas of the two bands is reduced while the dual-band antenna has a relatively small size. In addition, in this embodiment, because the first antenna is disposed vertically above a PCB 1, space above the first surface of the PCB in the housing of the terminal device can be fully utilized, thereby further improving space utilization in the terminal device.

In an embodiment of the first aspect of this application, the first feeding portion includes a first balun, configured to connect the first stub and the second stub of the first antenna to a first feeder. The first feeder is a coaxial cable including a first cable and a second cable, and the first feeder is perpendicular to the first direction and extends towards a direction that is of the first feeding portion and that is away from the first diagonal line.

A first end of the first balun is a reference location of the first antenna and is connected to the first stub and the first cable. A second end of the first balun is a feed point of the first antenna and is connected to the second stub and the second cable.

The second feeding portion includes a second balun, configured to connect the third stub and the fourth stub of the second antenna to a second feeder. The second feeder is a coaxial cable including a third cable and a fourth cable, and the second feeder is perpendicular to the second direction and extends towards a direction that is of the second feeding portion and that is away from the first diagonal line.

A first end of the second balun is a reference location of the second antenna and is connected to the third stub and the third cable. A second end of the second balun is a feed point of the second antenna and is connected to the fourth stub and the fourth cable.

Therefore, in the antenna provided in this embodiment, a policy of orthogonally disposing the baluns is used in the first antenna and the second antenna, and a cabling manner of separating the feeders from each other is used. In this way, mutual impact between the first antenna and the second antenna and mutual blocking of cables can be effectively reduced, and isolation between the two antennas is further improved and mutual impact between the two antennas is weakened while the antenna has a relatively small size.

According to a second aspect of this application, a terminal is provided. The terminal includes the antenna according to any one of the embodiments of the first aspect, and the antenna is disposed on a printed circuit board PCB of the terminal.

In conclusion, this application provides an antenna and a terminal. The antenna includes the printed circuit board PCB, the first antenna, and the second antenna. The first antenna includes the first feeding portion and the at least one stub. The first feeding portion is disposed on the first side of the first diagonal line of the rectangular region. The at least one stub of the first antenna extends from the first feeding portion in the first direction. There is the first angle between the first direction and the long-edge direction of the rectangular region. The second antenna includes the second feeding portion and the at least one stub. The second feeding portion is disposed on the second side of the first diagonal line of the rectangular region. The at least one stub of the second antenna extends from the second feeding portion in the second direction. There is the second angle between the second direction and the long-edge direction of the rectangular region. The first angle is different from the second angle. In the antenna provided in this application, the structure in which the first antenna and the second antenna extend in different directions and are disposed on the two sides of the diagonal line of the same rectangular region is used, and the structure can fully utilize space of the rectangular region, so that the two antennas extending at different angles can be as close as possible. In addition, because there is the specific angle between the first antenna and the second antenna, the polarization difference can be further formed, thereby reducing mutual interference between the first antenna and the second antenna and ensuring relatively high isolation between the first antenna and the second antenna. Therefore, the antenna and the terminal provided in this application can reduce mutual interference between the antennas of the two bands while the dual-band antenna has a relatively small size.

DETAILED DESCRIPTION OF ILLUSTRATIVE EMBODIMENTS

The following describes technical solutions of this application with reference to accompanying drawings.

This application provides an antenna, and in particular, a dual-band antenna, to reduce mutual interference between antennas of two bands in the dual-band antenna while the dual-band antenna has a relatively small size. The antenna provided in this application may be used in any terminal device that needs to send and receive a dual-band wireless signal. The terminal device may also be referred to as a terminal. The terminal device may be a device such as a mobile phone, a notebook computer, a tablet computer, a router, or an optical network termination (optical network termination, ONT).

Figure 1:
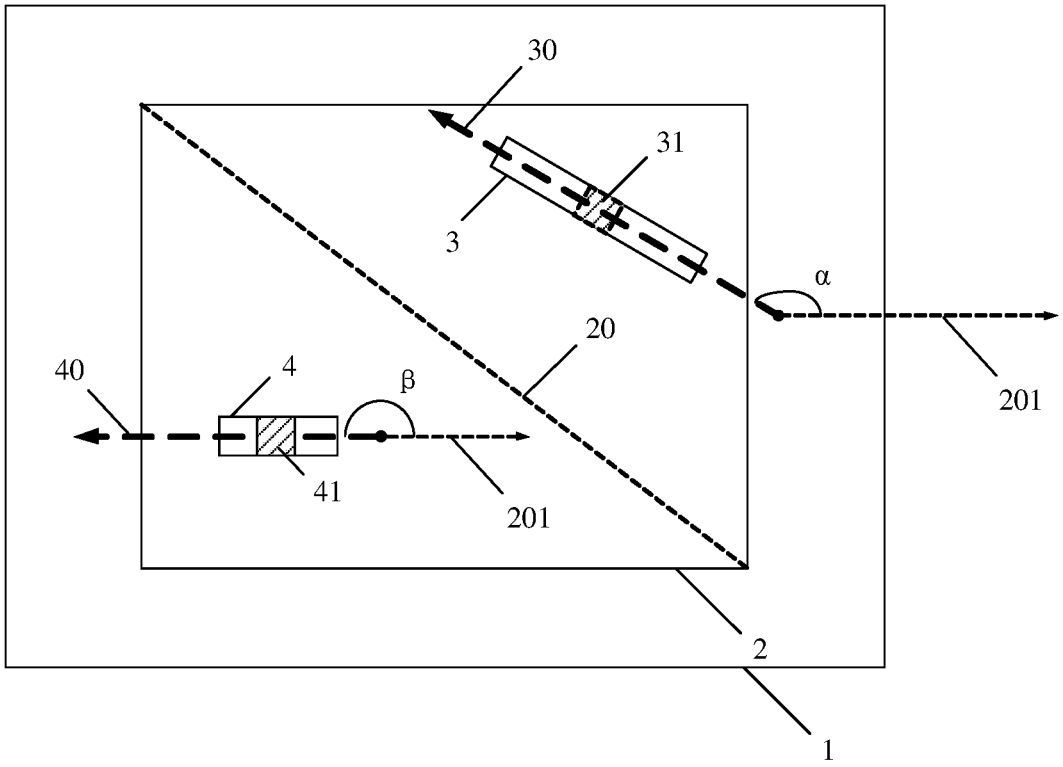
FIG. 1 is a schematic structural diagram of an antenna according to an embodiment of this application.
Figure 2:
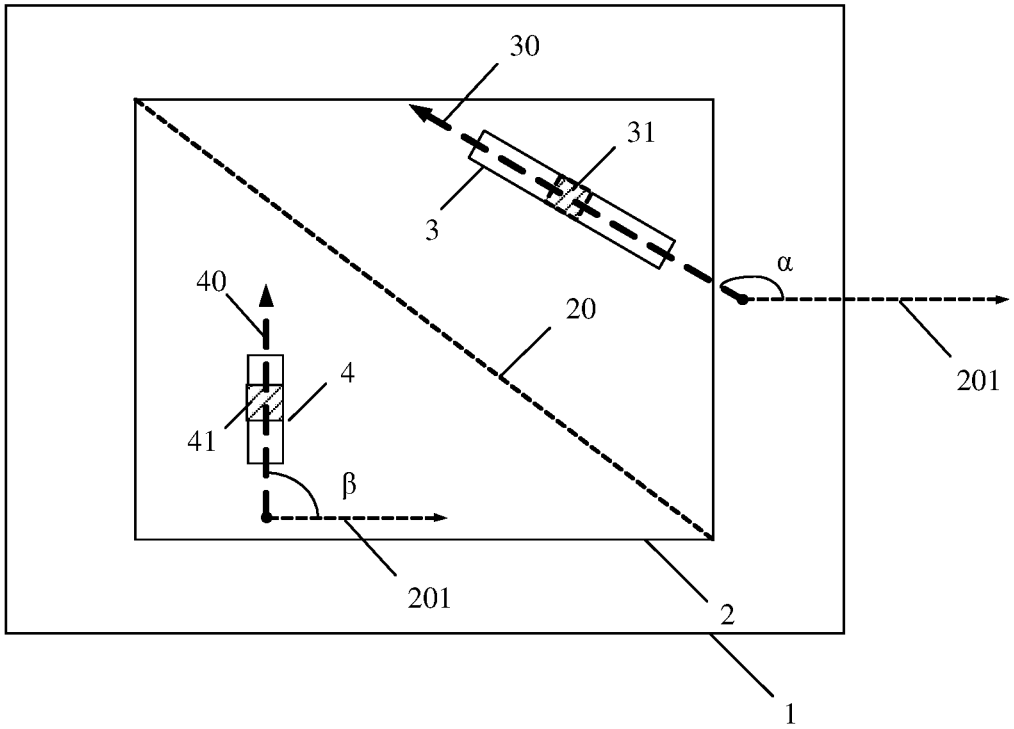
FIG. 2 is a schematic structural diagram of an antenna according to an embodiment of this application.

The following describes, with reference to FIG. 1 and FIG. 2, a possible implementation of the antenna provided in the embodiments. FIG. 1 is a schematic structural diagram of an antenna according to an embodiment of this application. As shown in FIG. 1, the antenna provided in this embodiment includes a printed circuit board (PCB) 1, a first antenna 3, and a second antenna 4.

Specifically, the first antenna 3 is partially or entirely printed in a rectangular region 2 of a first surface of the PCB 1, and is configured to respond to an electromagnetic wave of a first band. In FIG. 1, for example, the first antenna 3 is entirely printed in the rectangular region 2. The first antenna 3 is disposed on a first side of a first diagonal line 20 of the rectangular region 2. In FIG. 1, for example, the first side is an upper right side of the first diagonal line 20.

The first antenna 3 includes a first feeding portion 31 and at least one stub. The first feeding portion 31 is configured to when the first antenna 3 responds to the electromagnetic wave of the first band, perform mutual conversion between the electromagnetic wave of the first band and a wired signal. The at least one stub of the first antenna 3 extends from the first feeding portion 31 of the first antenna 3 in a first direction 30. As shown in FIG. 1, portions on two sides of the first feeding portion 31 of the first antenna 3 may be understood as two stubs separately extending to two sides of the first direction. For processing of the stub, refer to subsequent embodiments of this application. A form of extending the stub is not specifically limited in this embodiment. There is a first angle between the first direction 30 and a long-edge direction 201 of the rectangular region 2. In FIG. 1, an included angle between the first direction 30 and the long-edge direction 201 is a. It should be noted that extending, by the first antenna 3, in a direction of the first direction 30 herein includes extending in the first direction 30 and extending in a reverse direction of the first direction 30. Therefore, the first direction 30 in FIG. 1 is only a mark in this embodiment, and may also be the reverse direction of the first direction 30 in the figure.

The second antenna 4 is entirely printed in the rectangular region 2, and is configured to respond to an electromagnetic wave of a second band. The second antenna 4 is disposed on a second side of the first diagonal line 20 of the rectangular region 2, that is, the second antenna 4 and the first antenna 3 are separately disposed on two sides of the first diagonal line 20 of the rectangular region 2. In FIG. 1, for example, the second side of the first diagonal line 20 is a lower left side of the first diagonal line 20.

The second antenna 4 includes a second feeding portion 41 and at least one stub. The second feeding portion 41 is configured to when the second antenna 4 responds to the electromagnetic wave of the second band, perform mutual conversion between the electromagnetic wave of the second band and a wired signal. The at least one stub of the second antenna 4 extends from the second feeding portion 41 of the second antenna 4 in a second direction 40. As shown in FIG. 2, portions on two sides of the second feeding portion 41 of the second antenna 4 may be understood as two stubs separately extending to two sides of the second direction. For processing of the stub, refer to subsequent embodiments of this application. A form of extending the stub is not specifically limited in this embodiment. There is a second angle between the second direction 40 and the long-edge direction 201 of the rectangular region 2. In FIG. 2, an included angle between the second direction 40 and the long-edge direction 201 is β. Similarly, the second antenna 4 extends in a direction of the second direction 40 herein, and the second direction may be the second direction 40 or a reverse direction of the second direction 40 in the figure.

In particular, the first angle and the second angle in this embodiment are different, that is, the first direction 30 and the second direction 40 are different. For example, the first angle α is different from the second angle β in the example shown in FIG. 1, and the first direction 30 in which the first antenna extends is different from the second direction 40 in which the second antenna extends. It should be noted that, based on that the antenna provided in this application has the foregoing structure, the first angle and the second angle may be any angle provided that the first angle is different from the second angle. In FIG. 1, only an example in which the first angle is α and the second angle is β is used, and constitutes no limitation.

Therefore, the first antenna 3 and the second antenna 4 provided in this embodiment separately extend in the first direction 30 and the second direction 40, and the first direction 30 and the second direction 40 are different directions. Because a stub of the first antenna 3 extends in the first direction 30, a form of the first antenna 3 is equivalent to a dipole antenna disposed in the first direction 30. Because a stub of the second antenna 4 extends in the second direction 40, a form of the second antenna 4 is equivalent to a dipole antenna disposed in the second direction 40. The first antenna 3 and the second antenna 4 that are both dipole antennas are disposed at different angles, so that polarization directions of the first antenna 3 and the second antenna 4 are different, thereby forming a polarization difference. A structure in which the first antenna 3 and the second antenna 4 extend in different directions and are disposed on the two sides of the diagonal line of the same rectangular region is used, and the structure can fully utilize space of the rectangular region, so that the two antennas extending at different angles can be as close as possible. In addition, because there is a specific angle between the first antenna 3 and the second antenna 4, a polarization difference can be further formed, thereby reducing mutual interference between the first antenna 3 and the second antenna 4 in the dual-band antenna and ensuring relatively high isolation between the first antenna 3 and the second antenna 4. In conclusion, the antenna provided in this application can reduce mutual interference between the antennas of the two bands while a dual-band antenna has a relatively small size.

Optionally, in the foregoing embodiment, a portion that is of the first antenna 3 and that is printed on the PCB 1 may be printed in the rectangular region 2 of the PCB 1 by using a material and a process that are the same as those of a circuit line printed on the PCB 1. The material may be a metal conductor material, for example, copper commonly used for the PCB.

It should be noted that an original copper clad layer and another original conductor material of the PCB 1 should be removed from the entire rectangular region 2 of the PCB 1, to ensure that another portion of the rectangular region 2 other than the printed first antenna 3 and the printed second antenna 4 is entirely insulated, to keep a clearance condition of the antenna to be the same as that of an edge of the copper cladding layer of the PCB 1.

Optionally, the PCB 1 in the foregoing embodiment may be any existing PCB in the foregoing terminal device, or a PCB specifically disposed in the foregoing terminal device to implement the antenna in this embodiment.

Preferably, if the PCB 1 in the foregoing embodiment is a rectangle, the rectangular region 2 should be located at any angle of the rectangular PCB 1, that is, a vertex of the rectangular region 2 should coincide with a vertex of the rectangular PCB 1. In this way, the rectangular region 2 occupies a relatively concentrated position of the PCB 1 and occupies only one angle of the rectangular PCB 1, and a region of the PCB 1 other than the rectangular region 2 may still be used to implement another original function of the PCB 1.

Optionally, in the foregoing embodiment, both the feeding portion of the first antenna 3 and the feeding portion of the second antenna 4 should be connected to a wired cable, so that after the feeding portion converts, into a wired signal, a wireless electromagnetic wave signal to which at least one stub of the antenna responds, the wired signal is transmitted by using the wired cable, or after the feeding portion converts, into a wireless electromagnetic wave signal, a wired signal transmitted by the wired cable, the wireless electromagnetic wave signal is sent by using at least one stub.

Preferably, in the embodiment shown in FIG. 1, the first angle α of the included angle between the first direction 30 in which the first antenna 3 extends and the long-edge direction 201 is between 120° and 150°, that is, the first antenna 3 is disposed obliquely. Similarly, because the antenna extends towards two ends of the first direction, if a definition of the first direction is exactly opposite to that in FIG. 1, the first angle α is between 30° and 60°, that is, selection of the first direction does not affect a structure and a function of the antenna. The included angle β between the second direction 40 in which the second antenna 4 extends and the long-edge direction 201 is 90° or 180°, that is, the second antenna 4 is disposed parallel to or perpendicular to the long-edge direction 201 of the rectangular region.

Another manner of disposing the second antenna is shown in an embodiment of FIG. 2. FIG. 2 is a schematic structural diagram of an antenna according to an embodiment of this application. Except that the second direction 40 of the second antenna 4 is different from the second direction 40 in FIG. 1, other content is the same. Details are not described again.

Based on disposing in FIG. 1 and FIG. 2, the first antenna 3 is disposed obliquely on the first side of the first diagonal line 20 and the second antenna 4 is disposed in parallel or perpendicularly on the second side of the first diagonal line 20. Therefore, a length that may be set for the first antenna 3 may be greater than a length that may be set for the second antenna 4. Therefore, during design of the dual-band antenna, an antenna that is in the dual-band antenna and that is configured to respond to an electromagnetic wave having a relatively long wavelength may be disposed as the first antenna 3 in this embodiment, and an antenna that is in the dual-band antenna and that is configured to respond to an electromagnetic wave having a relatively short wavelength may be disposed as the second antenna 4 in this embodiment.

Further preferably, in this embodiment, an ONT device has an antenna that responds to an electromagnetic wave of a 2.4G wavelength and an antenna that responds to an electromagnetic wave of a 5G wavelength. In disposing of the ONT, a 2.4G antenna is disposed as the first antenna in this embodiment, and a 5G antenna is disposed as the second antenna in this embodiment.

Optionally, both the first antenna 3 and the second antenna 4 in the foregoing embodiment are dipole antennas. In this case, two stubs of the first antenna 3 have a same length and extend in the first direction and the reverse direction of the first direction, and both lengths of the two stubs are ¼ of a wavelength of the electromagnetic wave of the first band. Two stubs of the second antenna 4 have a same length and extend in the second direction and the reverse direction of the second direction, and both lengths of the two stubs are ¼ of a wavelength of the electromagnetic wave of the second band.

In particular, when a length of the at least one stub of the first antenna 3 is greater than that of the at least one stub of the second antenna 4, the first antenna 3 with a longer stub may be disposed obliquely on one side of the diagonal, and the second antenna 4 with a shorter stub may be disposed horizontally or perpendicularly on the other side of the diagonal. Because the stub of the first antenna 3 is longer, the at least one stub of the first antenna 3 may extend along two sides of the rectangular region 2, so that the stubs of the first antenna 3 "encircle" the second antenna 4 "like two arms". To be specific, a tight space coupling manner of encircling and nesting is used, and the at least one stub of the first antenna 3 is disposed in an "L" shape or in a detour cabling manner around the sides of the rectangular region 2, so that structures of the first antenna 3 and the second antenna 4 are more compact.

Figure 3:
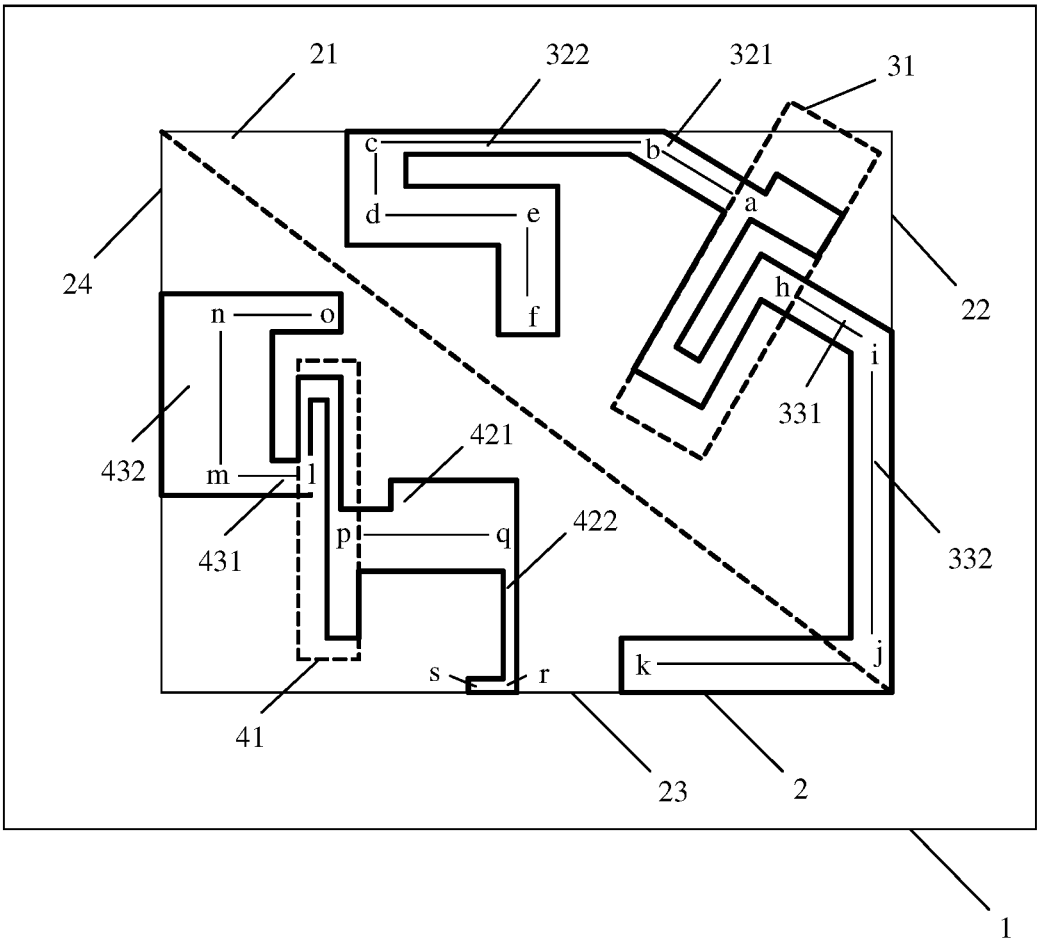
FIG. 3 is a schematic structural diagram of an antenna according to an embodiment of this application.
Figure 4:
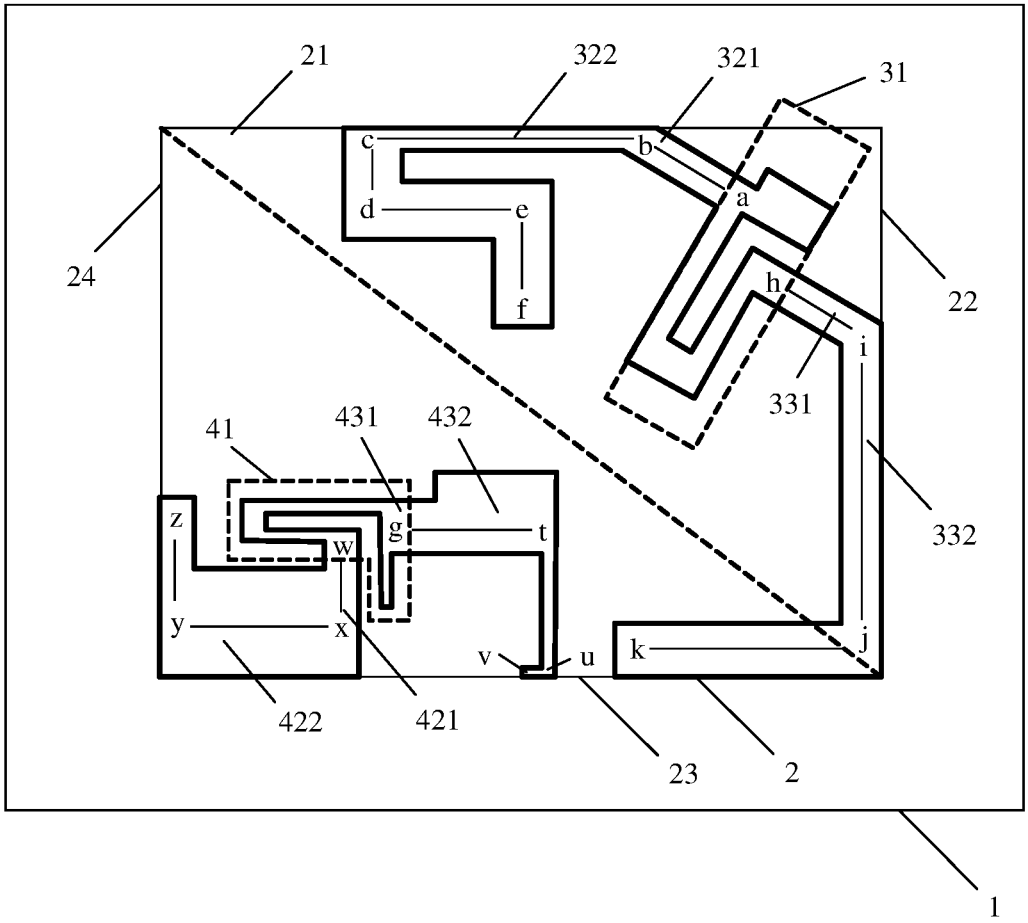
FIG. 4 is a schematic structural diagram of an antenna according to an embodiment of this application.

The following further describes the antenna in the embodiments with reference to FIG. 3 and FIG. 4.

FIG. 3 is a schematic structural diagram of an antenna according to an embodiment of this application. In the antenna provided in the embodiment shown in FIG. 3, based on the antenna shown in FIG. 1, the first antenna specifically includes a first stub and a second stub. The first stub of the first antenna includes at least a first portion 321 and a second portion 322, and the second stub of the first antenna includes at least a first portion 331 and a second portion 332. The second antenna specifically includes a third stub and a fourth stub. The third stub of the second antenna includes at least a first portion 421 and a second portion 422, and the fourth stub of the second antenna includes at least a first portion 431 and a second portion 432.

As shown in FIG. 3, the first portion 321 of the first stub extends from a first feeding portion 31 in a first direction (a-b shown in the figure), and the second portion 322 of the first stub extends from an end b of the first portion 321 and is disposed along a long edge 21 of a first side (b-c shown in the figure). A first stub of a dipole antenna needs to respond to the electromagnetic wave of the first band. Therefore, an equivalent length of the first stub needs to be ¼ of the wavelength of the electromagnetic wave of the first band. Herein, the first portion 321 and the second portion 322 of the first stub extend at different angles, and the entire a-c of the first stub need to respond to the electromagnetic wave of the first band. Therefore, a length and a width of the first stub need to be adjusted, so that the first stub that has been bent can respond to ¼ of the wavelength of the electromagnetic wave of the first band at the actual length.

It should be noted that the equivalent length in the embodiments of this application includes that a length of ¼ of a wavelength of an electromagnetic wave to which an antenna stub that has not been bent can respond is used as an equivalent length. After a length and a width are adjusted, the stub that has been bent has an actual length and the actual length is not equal to the equivalent length. The stub of the actual length and the stub whose equivalent length is ¼ of the wavelength of the electromagnetic wave have a same function, and respond to a same wavelength of an electromagnetic wave. To be specific, although the length a-c of the first stub is not ¼ of the wavelength of the electromagnetic wave of the first band, that is, is not the equivalent length, the first stub can still replace the stub of the equivalent length (¼ of the wavelength of the electromagnetic wave) as the stub that has been bent and that has the actual length, to respond to the electromagnetic wave of the first band. Further, if a sum (a-c shown in the figure) of lengths of the first portion 321 and the second portion 322 of the first stub is less than ¼ of the wavelength of the electromagnetic wave of the first band, the second portion 322 of the first stub needs to be bent, that is, the second portion 322 of the first stub is bent along the long edge 21 on the first side in FIG. 3. The second portion 322 of the first stub includes at least one bent portion. The at least one bent portion divides the second portion 322 of the first stub into b-c, c-d, d-e, and e-f in FIG. 3. A principle and a purpose of bending are to keep a plenty of distance between the second portion of the first stub and the second antenna to avoid mutual interference while the antenna has a smaller size.

The first portion 331 of the second stub extends from the first feeding portion 31 in a reverse direction of the first direction (h-i shown in the figure), and the second portion 332 of the second stub extends from an end i of the first portion 331 and is disposed along a wide edge 22 on the first side (i-j shown in the figure). A second stub of a dipole antenna needs to respond to the electromagnetic wave of the first band. A principle is the same as that of the first stub. The first portion 331 and the second portion 332 of the second stub extend at different angles. Therefore, a length and a width of the second stub need to be adjusted, so that the second stub that has been bent can respond to ¼ of the wavelength of the electromagnetic wave of the first band at an equivalent length. Further, if a sum (h-j shown in the figure) of lengths of the first portion 331 and the second portion 332 of the second stub is less than ¼ of the wavelength of the electromagnetic wave of the first band, the second portion 332 of the second stub needs to be bent, that is, the second portion 332 of the second stub is bent along the wide edge 22 on the first side in FIG. 3. The second portion 332 of the second stub includes at least one bent portion. The at least one bent portion divides the second portion 332 of the second stub into i-j and j-k in FIG. 3. A principle and a purpose of bending are also to keep a plenty of distance between the second portion 332 of the second stub and the second antenna to avoid mutual interference while the antenna has a smaller size.

The first portion 431 of the third stub extends from the second feeding portion 41 in the second direction (l-m shown in the figure), and the second portion 432 of the third stub extends from an end m of the first portion 431 and is disposed along a wide edge 24 on the second side (m-n shown in the figure). A third stub of a dipole antenna needs to respond to the electromagnetic wave of the second band. However, the first portion 431 and the second portion 432 of the third stub extend at different angles. Therefore, a length and a width of the third stub need to be adjusted, so that the third stub that has not been bent can respond to ¼ of the wavelength of the electromagnetic wave of the second band at an equivalent length. Further, if a sum of lengths of the first portion 431 and the second portion 432 of the third stub is less than ¼ of the wavelength of the electromagnetic wave of the second band, the second portion 432 of the third stub needs to be bent, that is, the second portion 432 of the third stub is bent along the wide edge 24 on the second side in FIG. 3. The second portion 432 of the third stub includes at least one bent portion. The at least one bent portion divides the second portion 432 of the third stub into m-n and n-o in FIG. 3. A principle and a purpose of bending are also to keep a plenty of distance between the second portion of the third stub and the first antenna to avoid mutual interference while the antenna has a smaller size.

The first portion 421 of the fourth stub extends from the second feeding portion 42 in a reverse direction of the second direction (p-q shown in the figure), and the second portion 422 of the fourth stub extends from an end q of the first portion 421 and is disposed along a long edge 23 on the second side (q-r shown in the figure). A fourth stub of a dipole antenna needs to respond to the electromagnetic wave of the second band. However, the first portion 421 and the second portion 422 of the fourth stub extend at different angles. Therefore, a length and a width of the fourth stub need to be adjusted, so that the fourth stub that has not been bent can respond to ¼ of the wavelength of the electromagnetic wave of the second band at an equivalent length. Further, if a sum of lengths of the first portion 421 and the second portion 422 of the fourth stub is less than ¼ of the wavelength of the electromagnetic wave of the second band, the second portion 422 of the fourth stub needs to be bent, that is, the second portion 422 of the fourth stub is bent along the long edge 23 on the second side in FIG. 3. The second portion 422 of the fourth stub includes at least one bent portion. The at least one bent portion divides the second portion 422 of the fourth stub into q-r and r-s in FIG. 3. A principle and a purpose of bending are also to keep a plenty of distance between the second portion of the fourth stub and the first antenna to avoid mutual interference while the antenna has a smaller size.

FIG. 4 is a schematic structural diagram of an antenna according to an embodiment of this application. The first antenna in the antenna provided in the embodiment shown in FIG. 4 is the same as that in FIG. 3. Details are not described again. A difference lies that in FIG. 3, the second direction in which the second antenna extends is parallel to the long-edge direction of the rectangular region, but in the embodiment of FIG. 4, the second direction in which the second antenna extends is perpendicular to the long-edge direction of the rectangular region.

As shown in FIG. 4, the first portion 431 of the third stub extends from the second feeding portion 41 in the second direction (g shown in the figure may be understood as an extended portion), and the second portion 432 of the third stub extends from an end g of the first portion 431 and is disposed along a long edge 23 on the second side (g-t shown in the figure). A third stub of a dipole antenna needs to respond to the electromagnetic wave of the second band. However, the first portion 431 and the second portion 432 of the third stub extend at different angles. Therefore, a length and a width of the third stub need to be adjusted, so that the third stub that has not been bent can respond to ¼ of the wavelength of the electromagnetic wave of the second band at an equivalent length. Further, if a sum of lengths of the first portion 431 and the second portion 432 of the third stub is less than ¼ of the wavelength of the electromagnetic wave of the second band, the second portion 432 of the third stub needs to be bent, that is, the second portion 432 of the third stub is bent along the long edge 23 on the second side in FIG. 3. The second portion 432 of the third stub includes at least one bent portion. The at least one bent portion divides the second portion 432 of the third stub into g-t, t-u, and u-v in FIG. 3. A principle and a purpose of bending are also to keep a plenty of distance between the second portion of the third stub and the first antenna to avoid mutual interference while the antenna has a smaller size.

The first portion 421 of the fourth stub extends from the second feeding portion 42 in a reverse direction of the second direction (w-x shown in the figure), and the second portion 422 of the fourth stub extends from an end x of the first portion 421 and is disposed along a long edge 23 on the second side (x-y shown in the figure). A fourth stub of a dipole antenna needs to respond to the electromagnetic wave of the second band. However, the first portion 421 and the second portion 422 of the fourth stub extend at different angles. Therefore, a length and a width of the fourth stub need to be adjusted, so that the fourth stub that has not been bent can respond to ¼ of the wavelength of the electromagnetic wave of the second band at an equivalent length. Further, if a sum of lengths of the first portion 421 and the second portion 422 of the fourth stub is less than ¼ of the wavelength of the electromagnetic wave of the second band, the second portion 422 of the fourth stub needs to be bent, that is, the second portion 422 of the fourth stub is bent along the long edge 23 on the second side in FIG. 3. The second portion 422 of the fourth stub includes at least one bent portion. The at least one bent portion divides the second portion 422 of the fourth stub into x-y and y-z in FIG. 3. A principle and a purpose of bending are also to keep a plenty of distance between the second portion of the fourth stub and the first antenna to avoid mutual interference while the antenna has a smaller size.

More specifically, this application further provides, based on the foregoing embodiments, an example of a specific size of the antenna shown in FIG. 4. Specifically, in the first antenna, a length and a width of the portion a-b are 3.7 mm and 1.3 mm respectively, a length and a width of the portion b-c are 8.5 mm and 0.8 mm, a length and a width of the portion c-d are 2.4 mm and 2 mm respectively, a length and a width of the portion d-e are 7 mm and 2 mm respectively, a length and a width of the portion e-f are 5 mm and 2 mm respectively, a length and a width of the portion h-i are 5 mm and 1.3 mm respectively, a length and a width of the portion i-j are 12 mm and 1.4 mm respectively, and a length and a width of the portion j-k are 9 mm and 1.8 mm respectively. In the second antenna, a length and a width of the portion g-t are 4.6 mm and 1.9 mm respectively, a length and a width of the portion t-u are 5.8 mm and 0.5 mm respectively, a length and a width of the portion u-v are 1.6 mm and 0.5 mm respectively, a length and a width of the portion w-x are 4.2 mm and 1.1 mm respectively, a length and a width of the portion x-y are 6.6 mm and 3.6 mm respectively, and a length and a width of the portion y-z are 6 mm and 1.2 mm respectively. It should be noted that a length of each portion herein is a length of the portion in an extending direction. For example, the length of the portion a-b is a length of the stub extending from a to b. Correspondingly, a width of each portion is a width between two sides when the stub extends from a to b. It may be understood that in this application, the actual length of the first antenna is a sum of the lengths of all the portions of the first antenna herein, and the actual length of the second antenna is a sum of the lengths of all the portions of the second antenna herein. Based on the setting of the lengths and widths of the stubs of the first antenna and the second antenna, the first antenna and the second antenna may be accommodated in a rectangular region with a length of 26 mm and a width of 19 mm, thereby greatly reducing a size of the antenna and reducing PCB space occupied by the antenna printed on the PCB.

The lengths and the widths of the stubs of the antenna provided in the embodiments are only an example of a specific implementation and are not intended to limit absolute values, and instead may be adjusted within a specific precision range, for example, from −1 mm to +1 mm, to achieve better isolation of the antenna. It should be noted that the length and the width of the antenna provided in this embodiment are a example obtained when the first antenna responds to the 2.4 GHz electromagnetic wave and the second antenna responds to the 5 GHz electromagnetic wave. If the first antenna and the second antenna respectively respond to electromagnetic waves of other bands, or a material of the antenna changes, or different types of PCBs are used, the lengths and the widths of the stubs of the antenna also need to be adjusted correspondingly. An adjustment manner may be based on a length and a width of an optimal antenna obtained in emulation software or an engineering test. In this application, only a relationship between relative positions of the two antennas is emphasized, and lengths and widths of extending the stubs of the two antennas are not specifically limited.

Further, in the antenna provided in the embodiments shown in FIG. 1 to FIG. 4, both the first antenna and the second antenna are entirely printed on the PCB, and the first antenna and the second antenna are formed in a part of the PCB. On this basis, only a part of the first antenna may be printed on the PCB, and the other part of the first antenna is connected, by using a steel sheet, to the part printed on the PCB. A shape of the first antenna including the two parts is the same as or different from that of the first antenna in the foregoing embodiments. The antenna in the embodiments is described below with reference to FIG. 5 to FIG. 7.

Figure 5:
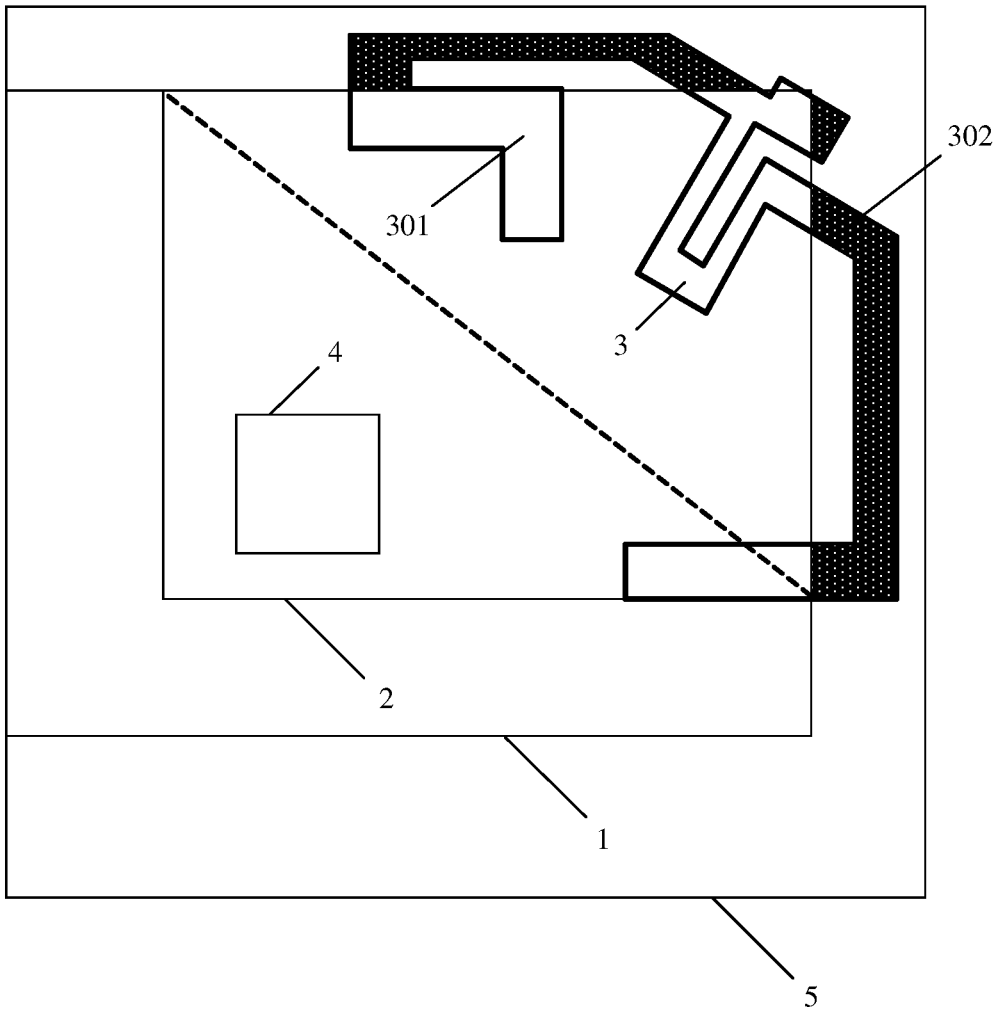
FIG. 5 is a schematic structural diagram of an antenna according to an embodiment of this application.

FIG. 5 is a schematic structural diagram of an antenna according to an embodiment of this application. As shown in FIG. 5, a first portion 301 of a first antenna 3 in this embodiment is printed in a rectangular region 2 of a PCB 1, a second portion 302 of the first antenna 3 is a steel sheet connected to the first portion 301, and a plane on which the second portion 302 of the first antenna 3 is located is parallel to a first surface of the PCB. An overall shape obtained by connecting the first portion 301 and the second portion 302 of the first antenna 3 in FIG. 5 is the same as that of the first antenna 3 in any one of FIG. 1 to FIG. 4, and the first portion 301 and the second portion 302 of the first antenna 3 are on one plane. Thicknesses of the first portion 301 and the second portion 302 of the first antenna may be the same or different, and may be adjusted based on an actual usage situation and materials of the first portion 301 and the second portion 302. The second antenna 4 shown in FIG. 5 is only an example. The second antenna 4 in any one of FIG. 1 to FIG. 4 may be used as the second antenna 4 herein, and implementations and principles are the same. Details are not described again.

In particular, because a part of the antenna in this embodiment is printed on the PCB and the other part of the antenna extends out of the PCB, an area of the PCB 1 occupied by the antenna can be further reduced. For example, an area of the rectangular region 2 shown in FIG. 5 is further reduced compared with that of the rectangular region in FIG. 1 to FIG. 4. In addition, the antenna provided in this embodiment can fully utilize space in a terminal device 5. When there is a gap between a PCB 1 of the terminal device and a housing 5 of the terminal device, the second portion 302 of the first antenna 3 of the antenna in this embodiment is disposed in the gap between the PCB 1 and the housing 5 in a form of a steel sheet, thereby further improving space utilization in the terminal device.

Figure 6:
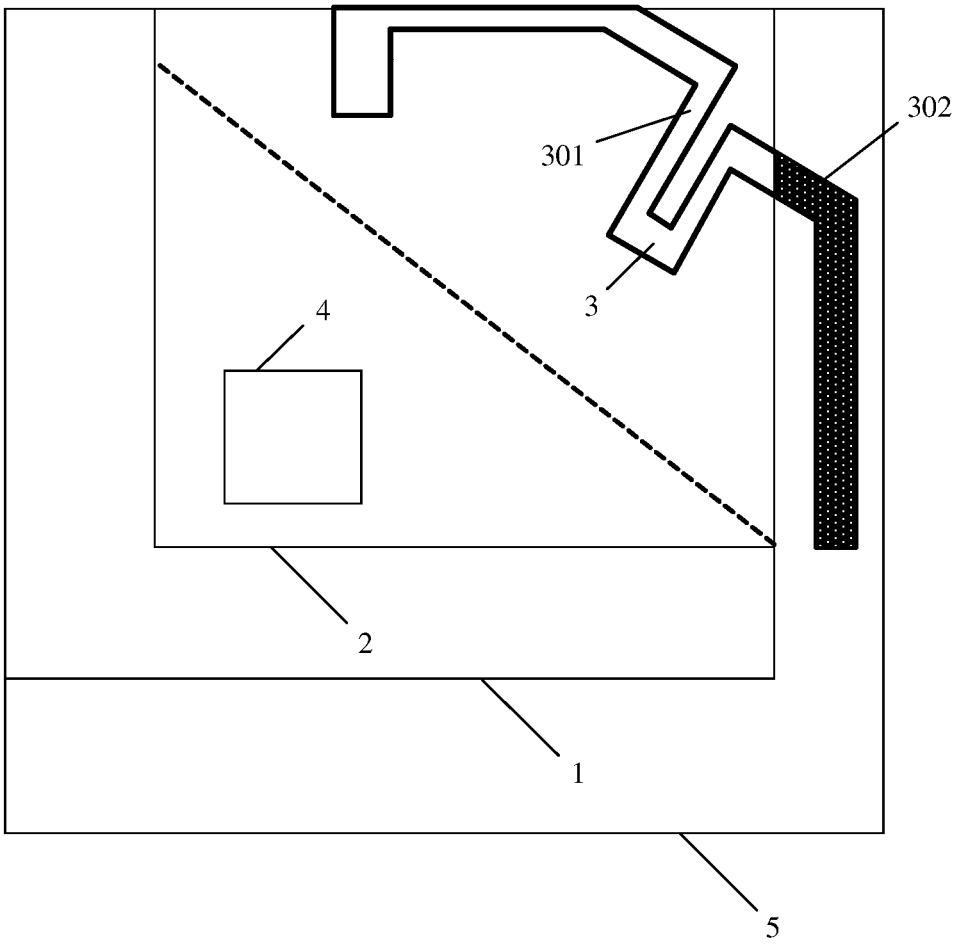
FIG. 6 is a schematic structural diagram of an antenna according to an embodiment of this application.

Optionally, FIG. 6 is a schematic structural diagram of an antenna according to an embodiment of this application. Based on FIG. 5, in the antenna shown in FIG. 6, the stub of the first antenna 3 does not need to be bent for a relatively large quantity of times based on the manner and the principle of the foregoing embodiment because the second portion 302 of the first antenna 3 has extended out of the PCB 1. Instead, the second portion 302 of the first antenna 3 needs to be bent only once or twice to directly extend in the gap between the PCB 1 and the housing 5 in the form of the steel sheet. In addition, in this embodiment, the rectangular region 2 is preferably disposed at any angle of the rectangular PCB 1, and a region of the PCB 1 other than the rectangular region 2 may still be used to implement another original function of the PCB 1. This not only reduces an original PCB area occupied by the antenna, but also can improve utilization of idle space between the PCB 1 and the housing 5.

Figure 7:
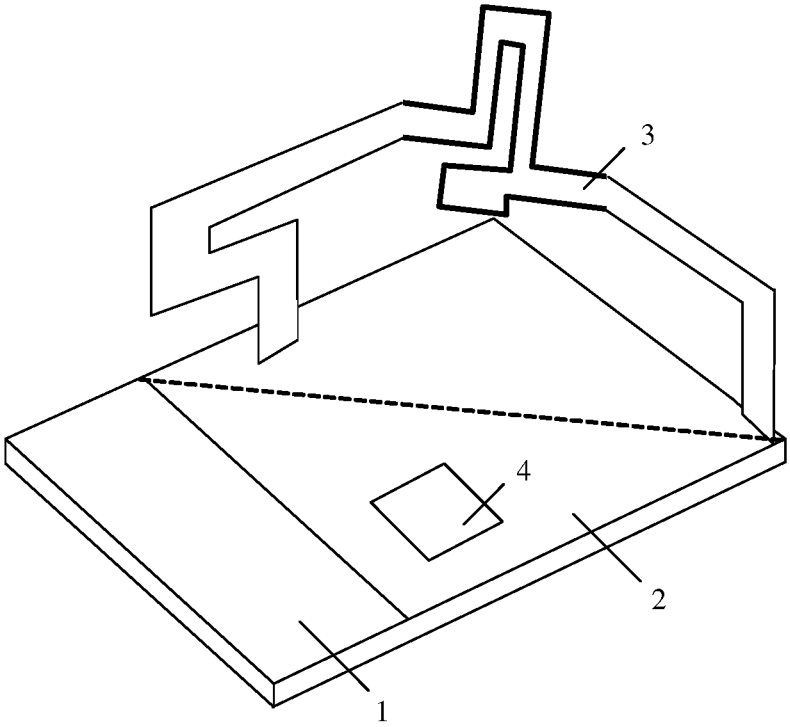
FIG. 7 is a schematic structural diagram of an antenna according to an embodiment of this application.

FIG. 7 is a schematic structural diagram of an antenna according to an embodiment of this application. In the embodiment shown in FIG. 7, a first antenna 3 is in a form of a steel sheet as a whole, and two ends of the steel sheet of the first antenna 3 are printed on a rectangular region 2 of a PCB 1, so that the first antenna 3 is connected to the PCB 1. Specifically, as shown in FIG. 7, the first antenna in any form in the foregoing embodiments may be used as the first antenna 3. Herein, the first antenna shown in FIG. 3 is used as an example. A first portion of the first antenna is printed in the rectangular region 2 of the PCB 1, and the first portion includes two endpoints of the first antenna that directly extend. A second portion of the first antenna is a steel sheet connected to the first portion, and the steel sheet is disposed on a plane perpendicular to a first surface of the PCB 1 and stands in the rectangular region 2 of the PCB 1 in a three-dimensional manner. In this disposing manner, because there is a specific angle between the first antenna and the second antenna, a polarization difference can be further formed, thereby reducing mutual interference between the first antenna and the second antenna and ensuring relatively high isolation between the first antenna and the second antenna. In this way, mutual interference between the antennas of the two bands is reduced while the dual-band antenna has a relatively small size. In addition, in this embodiment, because the first antenna 3 is disposed vertically above a PCB 1, space above the first surface of the PCB 1 in the housing of the terminal device can be fully utilized, thereby improving space utilization in the terminal device.

Figure 8:
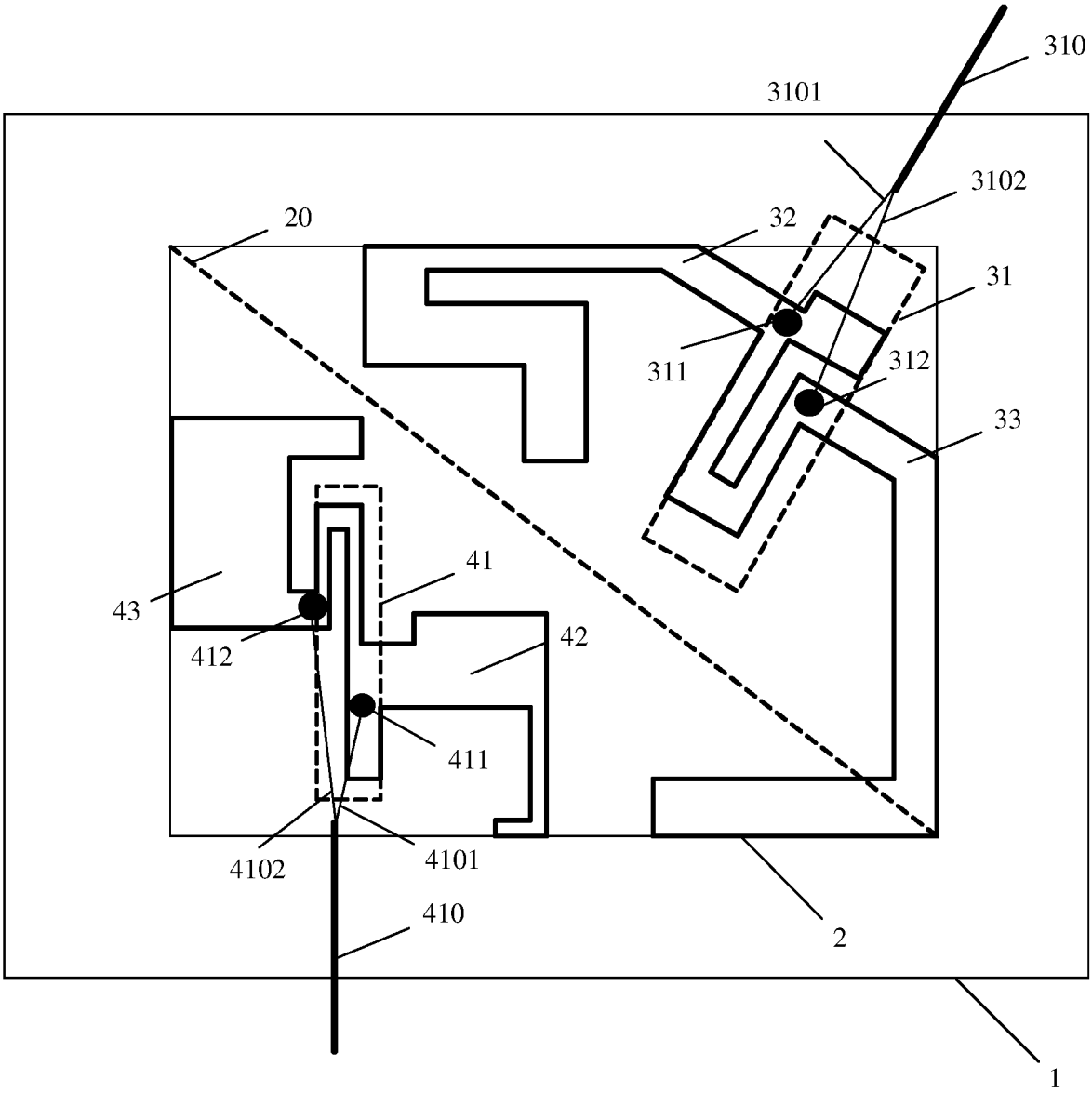
FIG. 8 is a schematic structural diagram of an antenna according to an embodiment of this application.

FIG. 8 is a schematic structural diagram of an antenna according to an embodiment of this application. This embodiment shows a possible implementation of the first feeding portion and the second feeding portion of the antenna in the foregoing embodiment. Both the first feeding portion and the second feeding portion in FIG. 1 to FIG. 7 may be implemented in forms shown in this embodiment. Specifically, as shown in FIG. 8, the first feeding portion 31 of the first antenna includes a first balun, configured to connect the first stub 32 and the second stub 33 of the first antenna to a first feeder 310. The first feeder 310 is a coaxial cable including a first cable 3101 and a second cable 3102, and the first feeder 310 is preferably perpendicular to the first direction and extends towards a direction that is of the first feeding portion 31 and that is away from the first diagonal line 20. A first end 311 of the first balun is a reference location of the first antenna and is connected to the first stub 32 and the first cable 3101. A second end 312 of the first balun is a feed point of the first antenna and is connected to the second stub 33 and the second cable 3102. The second feeding portion 41 includes a second balun, configured to connect the third stub 42 and the fourth stub 43 of the second antenna to a second feeder 410. The second feeder 410 is a coaxial cable including a third cable 4101 and a fourth cable 4102, and the second feeder 410 is perpendicular to the second direction and extends towards a direction that is of the second feeding portion 41 and that is away from the first diagonal line 20. A first end 411 of the second balun is a reference location of the second antenna and is connected to the third stub 42 and the third cable 4101. A second end 412 of the second balun is a feed point of the second antenna and is connected to the fourth stub 43 and the fourth cable 4102.

Therefore, in the antenna provided in this embodiment, a policy of orthogonally disposing the baluns is used in the first antenna and the second antenna, and a cabling manner of separating the feeders from each other is used. In this way, mutual impact between the first antenna and the second antenna and mutual blocking of cables can be effectively reduced, and isolation between the two antennas is further improved and mutual impact between the two antennas is weakened while the antenna has a relatively small size. A principle of a balun in the conventional technology may be used for the balun provided in this embodiment. In this embodiment, only an angle and a position of disposing the balun are emphasized. For a specific implementation principle, refer to an existing balun. In addition, only the second antenna shown in FIG. 3 is used as an example of the second antenna shown in FIG. 8 in this embodiment. A balun of a same structure and a same manner of disposing a cable may be used in FIG. 4 and are simple replacement. An implementation and a principle thereof are not described again.

Figure 9:
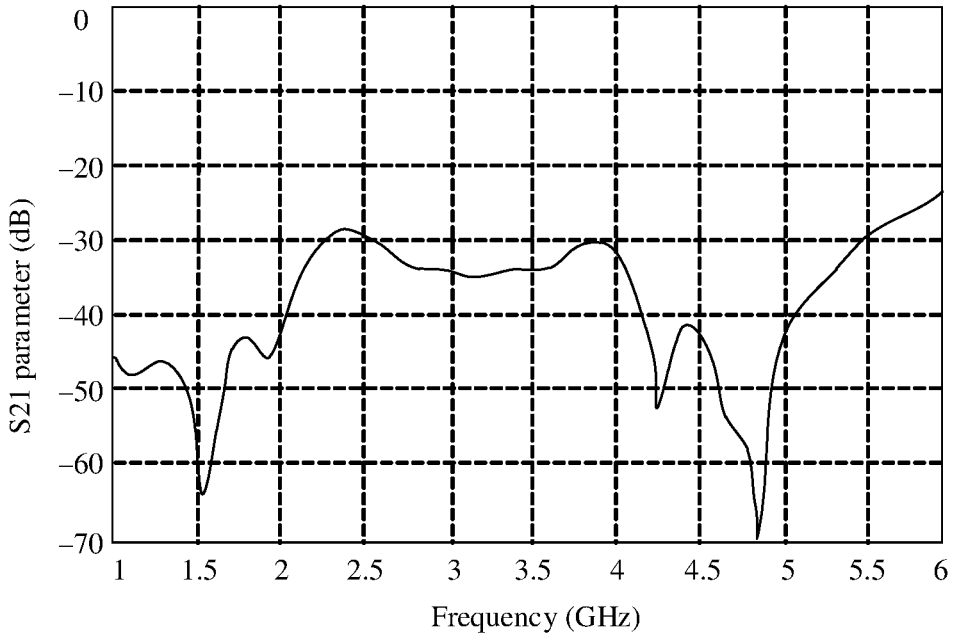
FIG. 9 is a schematic diagram of an S21 parameter of an antenna according to an embodiment of this application.

FIG. 9 is a schematic diagram of an S21 parameter of an antenna according to an embodiment of this application. The schematic diagram of S21 shown in FIG. 9 shows an S21 parameter that may be obtained by emulating or testing the antenna in FIG. 3 or FIG. 4 in the embodiments. As shown in FIG. 9, for a dipole antenna, the S21 parameter may represent isolation of the antenna, and higher isolation indicates smaller mutual interference between two antennas. During emulating or testing, for an electromagnetic wave of a corresponding frequency shown in a horizontal coordinate in FIG. 9, a corresponding S21 parameter of a vertical coordinate may be obtained. The curve shows that the antenna in the foregoing embodiment can achieve relatively desirable isolation for electromagnetic waves from 1 GHz to 6 GHz, and meet a requirement of −15 dB required as a wireless communications antenna, and can even achieve isolation of −20 dB to −70 dB. Therefore, the antenna in this embodiment can be used as an antenna that responds to a 2.4 GHz electromagnetic wave and a 5 GHz electromagnetic wave in a wireless communications system. It should be noted that, for a specific definition and a calculation method of the S21 parameter herein, refer to the conventional technology. In this application, the S21 parameter is used only to measure the isolation of the antenna.

Figure 10:
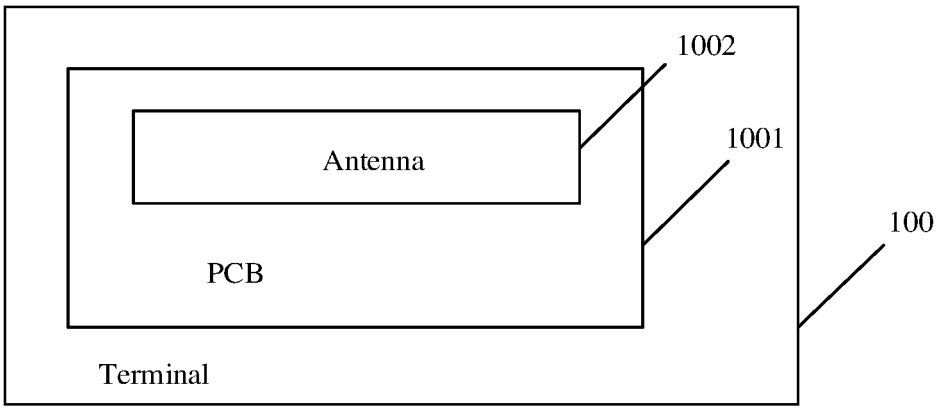
FIG. 10 is a schematic structural diagram of a terminal according to an embodiment of this application.

FIG. 10 is a schematic structural diagram of a terminal 100 according to an embodiment of this application. The terminal 100 provided in this application in FIG. 10 may also be referred to as a terminal device. The terminal 100 may include an antenna 1002 in any one of the embodiments in FIG. 1 to FIG. 8. A PCB 1001 of the antenna 1002 may be any PCB 1001 in the terminal, and in particular, may be a mainboard of the terminal, or a PCB 1001 that is specifically disposed in idle space of the terminal 100 to dispose the antenna 1002.

The foregoing implementations, schematic structural diagrams, or schematic emulation diagrams are only examples for describing the technical solutions of this application. Size proportions and emulation values thereof do not constitute any limitation on the protection scope of the technical solutions. Any modification, equivalent replacement, improvement, and the like made within the spirit and principle of the foregoing implementations shall fall within the protection scope of the technical solutions.

What is claimed is:

1. An antenna, comprising:

a printed circuit board (PCB);

a first antenna; and a second antenna;

wherein the first antenna is partially or entirely printed in a rectangular region of a first surface of the PCB, and is configured to respond to an electromagnetic wave of a first band, and the second antenna is entirely printed in the rectangular region, and is configured to respond to an electromagnetic wave of a second band;

wherein the first antenna comprises a first feeding portion and at least one stub;

wherein the first feeding portion is disposed on a first side of a first diagonal line of the rectangular region, and is configured to perform mutual conversion between the electromagnetic wave of the first band and a wired signal, wherein the at least one stub of the first antenna extends from the first feeding portion in a first direction, and wherein a first angle is disposed between the first direction and a long-edge direction of the rectangular region;

wherein the second antenna comprises a second feeding portion and at least one stub; and wherein the second feeding portion is disposed on a second side of the first diagonal line of the rectangular region, wherein the second feeding portion is configured to perform mutual conversion between the electromagnetic wave of the second band and a wired signal, wherein the at least one stub of the second antenna extends from the second feeding portion in a second direction, wherein a second angle is disposed between the second direction and the long-edge direction of the rectangular region, and wherein the first angle is different from the second angle.

2. The antenna according to claim 1, wherein the at least one stub of the first antenna comprises a first stub and a second stub, and wherein equivalent lengths of the first stub and the second stub are both ¼ of a wavelength of the electromagnetic wave of the first band;

wherein a first portion of the first stub extends, in the first direction, from the first feeding portion, and wherein a second portion of the first stub extends from an end of the first portion of the first stub and is disposed along a long edge on the first side;

wherein a first portion of the second stub extends, in a reverse direction of the first direction, from the first feeding portion, and wherein a second portion of the second stub extends from an end of the first portion of the second stub and is disposed along a wide edge on the first side;

wherein the at least one stub of the second antenna comprises a third stub and a fourth stub, and wherein equivalent lengths of the third stub and the fourth stub are both ¼ of a wavelength of the electromagnetic wave of the second band;

wherein a first portion of the third stub extends, in the second direction, from the second feeding portion, and wherein a second portion of the third stub extends from an end of the first portion of the third stub and is disposed along one of a long edge or a wide edge on the second side; and wherein a first portion of the fourth stub extends, in a reverse direction of the second direction, from the second feeding portion and is disposed along the long edge on the second side.

3. The antenna according to claim 2, wherein the first feeding portion comprises a first balun that connects the first stub and the second stub of the first antenna to a first feeder, wherein the first feeder is a coaxial cable comprising a first cable and a second cable, and wherein the first feeder is perpendicular to the first direction and extends in a direction that is of the first feeding portion and that is away from the first diagonal line;

wherein a first end of the first balun is a reference location of the first antenna and is connected to the first stub and the first cable, and wherein a second end of the first balun is a feed point of the first antenna and is connected to the second stub and the second cable;

wherein the second feeding portion comprises a second balun that connects the third stub and the fourth stub of the second antenna to a second feeder, wherein the second feeder is a coaxial cable comprising a third cable and a fourth cable, and wherein the second feeder is perpendicular to the second direction and extends in a direction that is of the second feeding portion and that is away from the first diagonal line; and wherein a first end of the second balun is a reference location of the second antenna and is connected to the third stub and the third cable, and wherein a second end of the second balun is a feed point of the second antenna and is connected to the fourth stub and the fourth cable.

4. The antenna according to claim 2, wherein a wavelength of an electromagnetic wave to which a respective stub that has not been bent can respond at the equivalent length is the same as a wavelength of an electromagnetic wave to which the respective stub that has been bent can respond at an actual length, and wherein the equivalent length of the first stub, second stub, third stub and fourth stub is ¼ of the wavelength of the electromagnetic wave.

5. The antenna according to claim 2, wherein the second portion of the first stub is bent along the long edge on the first side, and wherein the second portion of the first stub comprises at least one bent portion;

wherein the second portion of the second stub is bent along the wide edge on the first side, and wherein the second portion of the second stub comprises at least one bent portion;

wherein the second portion of the third stub is bent along one of the long edge or the wide edge on the second side, and wherein the second portion of the third stub comprises at least one bent portion; and wherein a second portion of the fourth stub is bent along the long edge on the second side, and wherein the second portion of the fourth stub comprises at least one bent portion.

6. The antenna according to claim 1, wherein the second direction is one of parallel to the long-edge direction of the rectangular region or perpendicular to the long-edge direction of the rectangular region.

7. The antenna according to claim 1, wherein the first antenna is at least partially printed in the rectangular region; and wherein a first portion of the first antenna is printed in the rectangular region, wherein a second portion of the first antenna is a steel sheet connected to the first portion of the first antenna, and wherein a plane on which the second portion of the first antenna is located is parallel to the first surface.

8. The antenna according to claim 1, wherein the first antenna is partially printed in the rectangular region;

wherein a first portion of the first antenna is printed in the rectangular region, and wherein the first portion comprises an endpoint that is of the at least one stub of the first antenna and that extends from the first feeding portion in the first direction; and wherein a second portion of the first antenna is a steel sheet connected to the first portion of the first antenna, and wherein a plane on which the steel sheet is located is perpendicular to the first surface.

9. The antenna according to claim 1, wherein the first angle is 30° to 60°.

10. A terminal, comprising:

a printed circuit board (PCB);

an antenna disposed on the PCB, wherein the antenna comprising a first antenna, and a second antenna;

wherein the first antenna is at least partially printed in a rectangular region of a first surface of the PCB, wherein the first antenna is configured to respond to an electromagnetic wave of a first band, wherein the second antenna is entirely printed in the rectangular region, and wherein the second antenna is configured to respond to an electromagnetic wave of a second band;

wherein the first antenna comprises a first feeding portion and at least one stub;

wherein the first feeding portion is disposed on a first side of a first diagonal line of the rectangular region, wherein the first feeding portion is configured to perform mutual conversion between the electromagnetic wave of the first band and a wired signal, wherein the at least one stub of the first antenna extends from the first feeding portion in a first direction, and wherein a first angle is disposed between the first direction and a long-edge direction of the rectangular region;

wherein the second antenna comprises a second feeding portion and at least one stub; and wherein the second feeding portion is disposed on a second side of the first diagonal line of the rectangular region, wherein the second feeding portion is configured to perform mutual conversion between the electromagnetic wave of the second band and a wired signal, wherein the at least one stub of the second antenna extends from the second feeding portion in a second direction, wherein a second angle is disposed between the second direction and the long-edge direction of the rectangular region, and wherein the first angle is different from the second angle.

11. The terminal according to claim 10, wherein the at least one stub of the first antenna comprises a first stub and a second stub, and wherein equivalent lengths of the first stub and the second stub are both ¼ of a wavelength of the electromagnetic wave of the first band;

wherein a first portion of the first stub extends, in the first direction, from the first feeding portion, and wherein a second portion of the first stub extends from an end of the first portion of the first stub and is disposed along a long edge on the first side;

wherein a first portion of the second stub extends, in a reverse direction of the first direction, from the first feeding portion, and wherein a second portion of the second stub extends from an end of the first portion of the second stub and is disposed along a wide edge on the first side;

whereon the at least one stub of the second antenna specifically comprises a third stub and a fourth stub, and wherein equivalent lengths of the third stub and the fourth stub are both ¼ of a wavelength of the electromagnetic wave of the second band;

wherein a first portion of the third stub extends, in the second direction, from the second feeding portion, and wherein a second portion of the third stub extends from an end of the first portion of the third stub and is disposed along a long edge or a wide edge on the second side; and wherein a first portion of the fourth stub extends, in a reverse direction of the second direction, from the second feeding portion and is disposed along the long edge on the second side.

12. The terminal according to claim 11, wherein the first feeding portion comprises a first balun that connects the first stub and the second stub of the first antenna to a first feeder, wherein the first feeder is a coaxial cable comprising a first cable and a second cable, and wherein the first feeder is perpendicular to the first direction and extends in a direction that is of the first feeding portion and that is away from the first diagonal line;

wherein a first end of the first balun is a reference location of the first antenna and is connected to the first stub and the first cable, and wherein a second end of the first balun is a feed point of the first antenna and is connected to the second stub and the second cable;

wherein the second feeding portion comprises a second balun that connects the third stub and the fourth stub of the second antenna to a second feeder, wherein the second feeder is a coaxial cable comprising a third cable and a fourth cable, and wherein the second feeder is perpendicular to the second direction and extends in a direction that is of the second feeding portion and that is away from the first diagonal line; and wherein a first end of the second balun is a reference location of the second antenna and is connected to the third stub and the third cable, and wherein a second end of the second balun is a feed point of the second antenna and is connected to the fourth stub and the fourth cable.

13. The terminal according to claim 11, wherein a wavelength of an electromagnetic wave to which the stub that has not been bent can respond at the equivalent length is the same as a wavelength of an electromagnetic wave to which the stub that has been bent can respond at an actual length, and wherein the equivalent length of the first stub, second stub, third stub and fourth stub is ¼ of the wavelength of the electromagnetic wave.

14. The terminal according to claim 11, wherein the second portion of the first stub is bent along the long edge on the first side, and wherein the second portion of the first stub comprises at least one bent portion;

wherein the second portion of the second stub is bent along the wide edge on the first side, and wherein the second portion of the second stub comprises at least one bent portion;

wherein the second portion of the third stub is bent along the long edge or the wide edge on the second side, and wherein the second portion of the third stub comprises at least one bent portion; and wherein a second portion of the fourth stub is bent along the long edge on the second side, and wherein the second portion of the fourth stub comprises at least one bent portion.

15. The terminal according to claim 10, wherein the second direction is one of parallel to the long-edge direction of the rectangular region, or perpendicular to the long-edge direction of the rectangular region.

16. The terminal according to claim 10, wherein the first antenna is at least partially printed in the rectangular region; and wherein a first portion of the first antenna is printed in the rectangular region, wherein a second portion of the first antenna is a steel sheet connected to the first portion of the first antenna, and wherein a plane on which the second portion of the first antenna is located is parallel to the first surface.

17. The terminal according to claim 10, wherein the first antenna is at least partially printed in the rectangular region;

wherein a first portion of the first antenna is printed in the rectangular region, and wherein the first portion comprises an endpoint that is of the at least one stub of the first antenna and that extends from the first feeding portion in the first direction; and wherein a second portion of the first antenna is a steel sheet connected to the first portion of the first antenna, and wherein a plane on which the steel sheet is located is perpendicular to the first surface.

18. The terminal according to claim 10, wherein the first angle is 30° to 60°.

19. A device, comprising:

a first antenna; and a second antenna;

wherein the first antenna is at least partially printed in a rectangular region of a first surface of a printed circuit board (PCB), wherein the first antenna is configured to respond to an electromagnetic wave of a first band, wherein the second antenna is entirely printed in the rectangular region, and wherein the second antenna is configured to respond to an electromagnetic wave of a second band;

wherein the first antenna comprises a first feeding portion and at least one stub;

wherein the first feeding portion is disposed on a first side of a first diagonal line of the rectangular region, wherein the first feeding portion is configured to perform mutual conversion between the electromagnetic wave of the first band and a wired signal, wherein the at least one stub of the first antenna extends from the first feeding portion in a first direction, and wherein a first angle is disposed between the first direction and a long-edge direction of the rectangular region;

wherein the second antenna comprises a second feeding portion and at least one stub; and wherein the second feeding portion is disposed on a second side of the first diagonal line of the rectangular region, wherein the second feeding portion is configured to perform mutual conversion between the electromagnetic wave of the second band and a wired signal, wherein the at least one stub of the second antenna extends from the second feeding portion in a second direction, wherein a second angle is disposed between the second direction and the long-edge direction of the rectangular region, and wherein the first angle is different from the second angle.

20. The device according to claim 19, wherein the at least one stub of the first antenna comprises a first stub and a second stub, and wherein equivalent lengths of the first stub and the second stub are both ¼ of a wavelength of the electromagnetic wave of the first band;

wherein a first portion of the first stub extends, in the first direction, from the first feeding portion, and wherein a second portion of the first stub extends from an end of the first portion of the first stub and is disposed along a long edge on the first side;

wherein a first portion of the second stub extends, in a reverse direction of the first direction, from the first feeding portion, and wherein a second portion of the second stub extends from an end of the first portion of the second stub and is disposed along a wide edge on the first side;

whereon the at least one stub of the second antenna specifically comprises a third stub and a fourth stub, and wherein equivalent lengths of the third stub and the fourth stub are both ¼ of a wavelength of the electromagnetic wave of the second band;

wherein a first portion of the third stub extends, in the second direction, from the second feeding portion, and wherein a second portion of the third stub extends from an end of the first portion of the third stub and is disposed along a long edge or a wide edge on the second side; and wherein a first portion of the fourth stub extends, in a reverse direction of the second direction, from the second feeding portion and is disposed along the long edge on the second side.

* * * * *